United States Patent [19]

Bannai

[11] Patent Number: 4,930,716

[45] Date of Patent: Jun. 5, 1990

[54] CABLE REEL

[75] Inventor: Hiroyuki Bannai, Miyagi, Japan

[73] Assignee: Alps Electric Co., Ltd., Tokyo, Japan

[21] Appl. No.: 312,013

[22] Filed: Feb. 16, 1989

[30] Foreign Application Priority Data

Apr. 4, 1988 [JP] Japan ..... 63-44724[U]

[51] Int. Cl.[5] ..... H01R 39/02

[52] U.S. Cl. ..... 242/85; 439/15; 439/164

[58] Field of Search ..... 242/84.8, 85, 107.4 R; 439/15, 27, 163, 164

[56] References Cited

U.S. PATENT DOCUMENTS

| | | | |
|---|---|---|---|
| 4,502,746 | 3/1985 | Wawra et al. . | |
| 4,744,763 | 5/1988 | Suzuki et al. . | |
| 4,824,396 | 4/1989 | Sasaki et al. | 439/15 X |
| 4,838,803 | 6/1989 | Kondo | 439/15 X |

*Primary Examiner*—Stuart S. Levy

*Assistant Examiner*—Steven M. du Bois

*Attorney, Agent, or Firm*—Guy W. Shoup; Paul J. Winters

[57] ABSTRACT

A cable reel including a fixed member, a movable member rotatably engaged with the fixed member in such a manner that a space is defined between the fixed member and the movable member, a flat cable received in the space under a wound condition with predetermined turns and having opposite ends fixed to the fixed member and the movable member and extending outside, and a cutter provided in the vicinity of a fixed portion of the flat cable on the flat member side, wherein when the movable member is rotated by a predetermined amount or more, the flat cable is cut by the cutter. The improvement is that the flat cable comprises a first flat cable and a second flat cable attached to each other, and that a length from a fixed portion of the first flat cable on the movable member side to the cutter is different from a length from a fixed portion of the second flat cable on the movable member side to the cutter.

5 Claims, 2 Drawing Sheets

CABLE REEL

FIELD OF THE INVENTION

The present invention relates to a cable reel having a flat cable utilized for electrical connection between a fixed member and a movable member, and more particularly to a cable reel suitable for use with a steering device for an automobile.

BACKGROUND OF THE INVENTION

A cable reel includes a flat cable constructed in a wound condition with a plurality of turns. The flat cable is fixed at its one end to a fixed member, and is also fixed at the other end to a movable member. The flat cable extends from both ends to the outside of the cable reel. When the movable member is rotated, the flat cable is wound up around the movable member, or it is unwound from the movable member. Thus, the movable member is allowed to be rotated by a predetermined amount. For example, the cable reel is used in a steering device for an automobile.

The flat cable as mentioned above is formed by laminating a plurality of conductor foils between a pair of flexible films such as polyethylene terephthalate (PET). In installing the cable reel in various equipment, e.g., the steering device as mentioned above, it is necessary to allow the flat cable to rotate in opposite direction about a neutral position by substantially the same amount. Further, considering possible erroneous mounting of the flat cable, a cutter is provided in the vicinity of a fixed portion of the flat cable to the fixed member, so that when the movable member is rotated by an amount greater than the predetermined amount, the flat cable is cut by the cutter to thereby prevent locking of the movable member due to the erroneous mounting of the cable reel.

Recently, an increase in the circuits to be connected through the flat cable have been proposed, and it has also been proposed that the cable reel be installed in as small a space as possible. To satisfy these proposals an arrangement that has been considered is that as many conductor foils as possible be arranged within a given width of the flat cable by reducing a pitch (spacing) between the adjacent conductor foils, or that the width of the flat cable be made as narrow as possible. However, if the pitch (spacing) between the adjacent conductor foils is excessively reduced, there is a possibility that the flexible films will peel from each other or that adjacent conductor foils will be short-circuited. As a result, the reliability of the cable reel will be remarkably reduced.

SUMMARY OF THE INVENTION

Accordingly, it is a primary object of the present invention to provide a cable reel which may ensure the reliability of the electrical connection and may be reduced in size.

It is another object of the present invention to provide a cable reel which may prevent locking of the movable member without cutting essential circuits necessary for safety.

According to the present invention, there is provided in a cable reel a fixed member, a movable member rotatably engaged with said fixed member in such a manner that a space is defined between said fixed member and said movable member, a flat cable received in said space in a wound condition with predetermined turns, said flat cable having opposite ends fixed to said fixed member and said movable member and extending outside, and a cutter provided in the vicinity of a fixed portion of said flat cable on said flat member side, wherein when said movable member is rotated by a predetermined amount or more, said flat cable is cut by said cutter; the improvement wherein said flat cable comprises a first flat cable and a second flat cable attached to each other, and a length from a fixed portion of said first flat cable on said movable member side to said cutter is different from a length from a fixed portion of said second flat cable on said movable member side to said cutter.

As compared with the prior art cable reel employing a single flat cable, the present invention employing the double flat cable is advantageous because the number of circuits to be installed can be doubled to thereby reduce the size and avoid the short-circuit of the conductors, thus improving the safety. Furthermore, if the first and second flat cables are erroneously mounted, the shorter flat cable is preferentially cut by the cutter. Accordingly, the essential circuits such as a horn circuit and an air bag circuit may be connected through the longer flat cable even in the case of such erroneous mounting of the flat cables.

Other objects and features of the invention will be more fully understood from the following detailed description and appended claims when taken with the accompanying drawings.

DETAILED DESCRIPTION OF THE PREFERRED EMBODIMENTS

Figure 1:
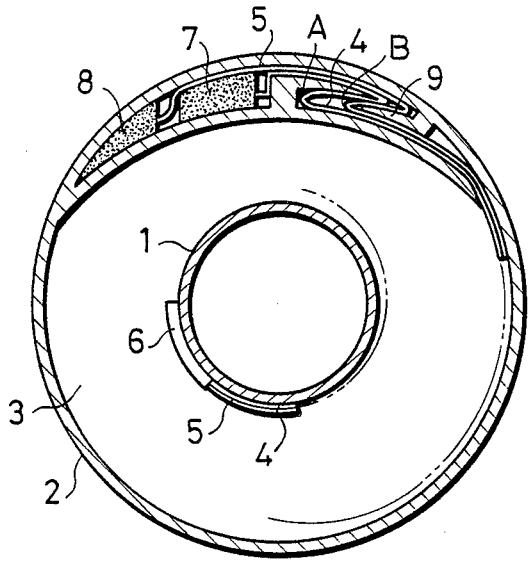
FIG. 1 is a sectional view of the cable reel according to a first preferred embodiment of the present invention.
Figure 2:
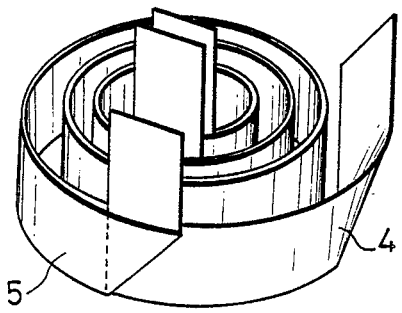
FIG. 2 is a perspective view of the first and second flat cables in the cable reel.
Figure 3:
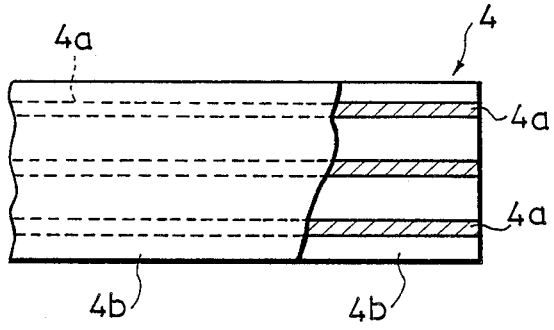
FIG. 3 is a plan view of the first flat cable.

Referring now to FIGS. 1 to 3 which show the first preferred embodiment of the present invention, the cable reel is generally constructed of a movable member 1 having a central cylindrical inner ring wall and a fixed member 2 rotatably supporting the movable member 1. Under the assembled condition of the movable member 1 and the fixed member 2, a given space 3 is defined between the inner ring wall of the movable member 1 and the fixed member 2.

A first flat cable 4 and a second flat cable 5 are attached to each other as shown in FIG. 2, and they are housed in the space 3. As shown in FIG. 3, the first flat cable 4 is formed by laminating a plurality of conductors 4*a* made of good conductive material such as copper between two flexible films 4*b* made of PET, for example. The first flat cable 4 is utilized for connection with a horn circuit and an air bag circuit, for example, which are essential circuits for the safety. On the other hand, the second flat cable 5 is formed in the same manner as the first flat cable 4, but it is utilized for connection with a replaceable circuit such as a cruise control circuit even if disconnection occurs. The second flat cable 5 is also connected with a disconnection warning circuit.

As shown in FIG. 1, each one end of the first and second flat cables 4 and 5 is fixed to a connector 6 provided on the inner ring wall of the movable member 1, and is doubled back at the connector 6 to extend out of the movable member 1. The other ends of the first and second flat cables 4 and 5 are fixed to connectors 7 and 8, respectively, which are provided on an outer ring wall of the fixed member 2, and are doubled back at the connectors 7 and 8 to extend out of the fixed member 2. A knife-edge like cutter 9 is provided in the vicinity of the connectors 7 and 8. The first and second flat cables 4 and 5 are doubled back at the cutter 9, and when a tension greater than a set value is applied to the flat cables 4 and 5, they are cut by the cutter 9. A length from the fixed portion of the first flat cable 4 on the movable member 1 side (i.e., from the connector 6 in the preferred embodiment) to a double line A at the cutter 9 is unequal to a length from the same fixed portion of the second flat cable 5 to a doubling line B at the cutter 9. That is, the length as of the first flat cable 4 is set to be sufficiently greater than the length as of the second flat cable 5.

The cable reel thus constructed is actually used in such a manner that the movable member 1 is mounted on a steering wheel side of a steering device for an automobile and the fixed member is mounted on a bearing side of a steering shaft. When the steering wheel (the movable member 1) is rotated in one direction, the first and second flat cables 4 and 5 are wound up on the inner ring wall of the movable member 1. Reversely, when the steering wheel is rotated in the other direction, the first and second flat cables 4 and 5 are unwound on the outer ring wall of the fixed member 2. Under any conditions, electrical connection (horn circuit, cruise control circuit, etc.) between the movable member 1 and the fixed member 2 is ensured via both the flat cables 4 and 5.

In mounting the cable reel into the steering device for the automobile as mentioned above, it is necessary to make an amount of rotation of the movable member 1 in one direction from its neutral position substantially equal to that in the other direction. In other words, if the movable member 1 is mounted in the condition where it has slipped from the neutral position, the amount of rotation of the movable member 1 in one direction differs from that in the other direction, causing a problem that while steering operation in one direction can be effected, that in the other direction cannot be sufficiently effected. To cope with this problem, the cable reel is provided with a positioning mechanism (not shown) serving as an index for ensuring the positioning between the movable member 1 and the fixed member 2. However, there are cases where such positioning is erroneously carried out.

In the case of such erroneous positioning, especially when the amount of rotation of the movable member 1 in the winding direction of both the flat cables 4 and 5 is less, and when the steering wheel is rotated by a predetermined amount, the double line B of the second shorter flat cable 5 is first urged to the cutter 9 and is cut thereby. Accordingly, until the doubling line A of the first longer flat cable 4 faces the cutter 9, the steering wheel may be rotated. Of course, the doubling line A of the first flat cable 4 may be cut by the cutter 9. However, since the second flat cable 5 is connected to the disconnection warning circuit or the like, cutting of the second flat cable 5 can be acknowledged by a driver by way of a warning lamp or the like. Therefore, cutting of the first flat cable 4 utilized for connection with the essential circuits such as the horn circuit and the air bag circuit may be preliminarily avoided.

In the preferred embodiment, as the two flat cables 4 and 5 are attached to each other to form the cable reel, the necessary circuits may be distributed in the two flat cables 4 and 5, thereby preventing short-circuit between the conductors and also making a width of the flat cables 4 and 5 small, namely, making a size of the cable reel small (thin). Further, as the second flat cable 5 is designed to be preferentially cut if the cable reel is erroneously mounted, the essential circuits are preliminarily prevented from being disconnected.

Figure 4:
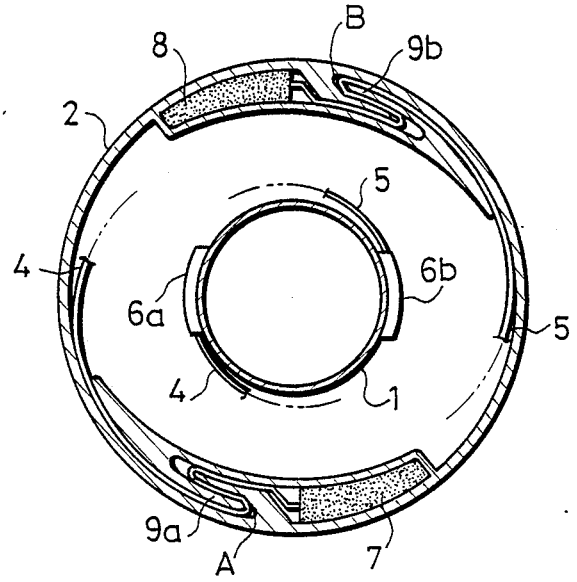
FIG. 4 is a sectional view of the cable reel according to a second preferred embodiment of the present invention.

Referring next to FIG. 4 which shows the second preferred embodiment of the present invention, the corresponding parts as in FIG. 1 are designated by the same reference numerals. The second preferred embodiment is different from the first preferred embodiment in such a construction that the first and second flat cables 4 and 5 are fixed at different portions of the movable member 1, and that two cutters are provided for the first and second flat cables 4 and 5, respectively. The other construction is basically the same as in the first preferred embodiment. As shown in FIG. 4, the first flat cable 4 is fixed at its one end to a connector *6a* provided on the inner ring wall of the movable member 1, and is also fixed at the other end to a connector 7 provided on the outer ring wall of the fixed member 2. A cutter *9a* is provided in the vicinity of the connector 7, and is opposed to the doubling line A of the first flat cable 4. On the other hand, the second flat cable 5 is fixed at its one end to a connector *6b* provided on the inner ring wall of the movable member 1, and is also fixed at the other end to a connector 8 provided on the outer ring wall of the fixed member 2. A cutter *9b* is provided in the vicinity of the connector 8, and is opposed to the doubling line B of the second flat cable 5. A length from the fixed portion (the connector *6a*) of the first flat cable 4 to the doubling line A is set to be sufficiently greater than the length from the fixed portion (the connector *6b*) of the second flat cable 5 to the doubling line B, so that the second flat cable 5 may be preferentially cut if the cable reel is erroneously mounted.

Although the cutter is integrally formed with the fixed member 2 in the above-mentioned preferred embodiments, it may be formed independently of the fixed member 2. Further, both the flat cables 4 and 5 need not have the same construction but have different constructions. For example, either of the flat cable 4 or 5 may include a copper foil conductor, and the other may include a silver paste conductor.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A cable reel comprising:

a fixed member;

a moveable member rotably engaged with said fixed member in such a manner that a space is defined between said fixed member and said moveable member;

a flat cable received in said space in a wound condition with a predetermined number of turns, said flat cable having opposite ends fixed to said fixed member and said movable member; and a cutter provided in the vicinity of a fixed portion of said flat cable on said fixed member, wherein when said movable member is rotated by a predetermined amount or more, said flat cable is cut by said cutter;

the improvement wherein said flat cable comprises a first flat cable and a second flat cable attached to each other and a first length from a fixed portion of said first flat cable on said movable member to said cutter is different from a second length from a fixed portion of said second flat cable on said movable member to said cutter.

2. The cable reel as defined in claim 1, wherein said fixed portion of said first flat cable on said movable member and said fixed portion of said second flat cable on said movable member are located at different positions, and said cutter comprises a first cutter and a second cutter located at different positions.

3. The cable reel as defined in claim 2, wherein said first flat cable is fixed at its one end to a first connector provided on an inner ring wall of said movable member, and is also fixed at the other end to a second connector provided on an outer ring wall of said fixed member, and said first cutter is provided in the vicinity of said second connector in such a manner as to be opposed to a doubling line of said first flat cable, while said second flat cable is fixed at its one end to a third connector provided on said inner ring wall of said movable member, and is also fixed at the other end to a fourth connector provided on said outer ring wall of said fixed member, and said second cutter is provided in the vicinity of said fourth connector in such a manner as to be opposed to a doubling line of said second flat cable.

4. A cable reel comprising:

a fixed member, a movable member rotably engaged with said fixed member in such a manner that a space is defined between said fixed member and said moveable member, a flat cable received in said space in a wound condition with a predetermined number of turns, said flat cable being comprised of a first flat cable and a second flat cable, said first and second flat cables each having opposite ends fixed to said fixed member and said movable member, said first flat cable being shorter than said second flat cable; and a cutter provided on said fixed member disposed such that when the movable member is rotated a first predetermined amount said first flat cable is cut by said cutter while said second flat cable is not cut by said cutter.

5. A cable reel as in claim 4 such that when the movable member is rotated a second predetermined amount said first and said second flat cable are cut by said cutter.

* * * * *